United States Patent [19]

Kelly et al.

[11] 4,332,326

[45] * Jun. 1, 1982

[54] PLASTIC NETTING FOR LOAD UNITIZATION

[75] Inventors: Michael G. Kelly, Blaine; Eugene R. Pastien, Moundsview, both of Minn.

[73] Assignee: Conwed Corporation, St. Paul, Minn.

[ * ] Notice: The portion of the term of this patent subsequent to Jun. 17, 1997, has been disclaimed.

[21] Appl. No.: 139,131

[22] Filed: Apr. 10, 1980

Related U.S. Application Data

[63] Continuation-in-part of Ser. No. 35,851, May 4, 1979, Pat. No. 4,208,457.

[51] Int. Cl.[3] ..... B65D 77/08; B65D 19/00; B65D 85/62; B65D 6/08

[52] U.S. Cl. ..... 206/497; 206/597

[58] Field of Search ..... 206/497, 386, 597

[56] References Cited

U.S. PATENT DOCUMENTS 4,136,501 1/1979 Connolly ..... 206/597
4,206,846 6/1980 Connolly ..... 206/597

FOREIGN PATENT DOCUMENTS 2207573 8/1973 Fed. Rep. of Germany ..... 206/497

*Primary Examiner*—William T. Dixson, Jr.
*Attorney, Agent, or Firm*—Eyre, Mann, Lucas & Just

[57] ABSTRACT

An improved wrapping material for palletized loads which are tension wrapped is disclosed. A plastic net material comprising the plurality of sets of strands, the strands of at least one said set being substantially parallel, is oriented along said one said set to have a stretch factor of less than 15% in the oriented direction. This net is used for wrapping about pelletized loads and gives substantially improved results over known plastic net materials used in tension wrapping of palletized loads.

16 Claims, 1 Drawing Figure

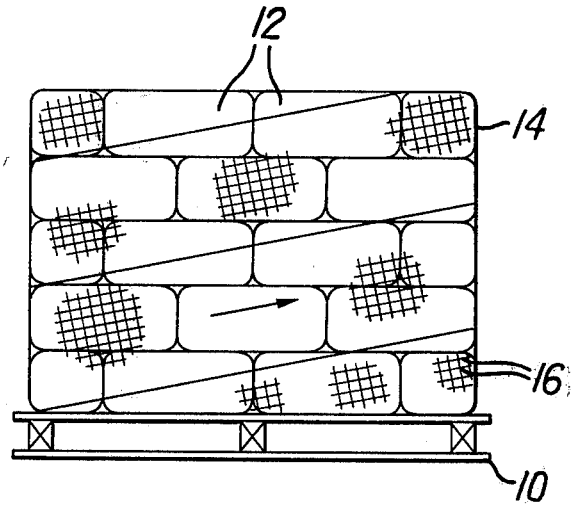
12
14
16
10

PLASTIC NETTING FOR LOAD UNITIZATION

This application is a continuation-in-part of our prior application, Ser. No. 035,851 filed May 4, 1979, now U.S. Pat. No. 4,208,457 issued on June 17, 1980.

The present invention relates to packaging materials and in particular to an improved plastic net for the tension wrapping of palletized loads.

Tension wrapping of palletized loads is well known in the art and is taught for example in U.S. Pat. Nos. 3,495,375; 3,867,806; and 4,067,174. In these patents there is taught the wrapping of palletized loads using films, such as those of polyethylene. There are, however, known disadvantages to the use of films and these can be overcome by using plastic nets.

The use of plastic nets for wrapping palletized loads is also well-known in the art. This is disclosed, for example, in the U.S. Pat. Nos. 3,945,493 and 4,136,501. The former patent teaches a process in which the net is heat shrunk about the load while the latter patent teaches a process in which the net is stretched as it is being applied under tension. Each of these has substantial disadvantage from a commercial point of view.

With the process in which the net is stretched as it is applied, it is most important that the degree and rate of stretching be carefully controlled as the netting is wrapped around the load. This is a disadvantage since it means that any discontinuity in the wrapping process requires one to start all over again in order to assure uniform stretching. In addition, since the material being applied is stretched as it is applied but is not stretched to its limit, it is capable of being stretched after it is on the load. This has been found to be a substantial disadvantage, especially with relatively heavy loads moving over relatively rough roads. Further, the temperature at which the netting is applied is a factor which can have great bearing on pallets wrapped by this process. If the pallet is wrapped at ambient temperatures in cooler climes and the load is then shipped to warmer climes, the changes in temperature while the pallet is being shipped can cause great loosening of the load.

With the heat shrink netting, the most prominent disadvantage is the need for an oven-like apparatus or gun-like apparatus for heating the net to cause it to heat shrink about the load. This method is quite costly to use due to energy consumption of the apparatuses. It is also difficult to obtain uniform tension on the load. Furthermore, materials which heat shrink will also heat stretch. This makes employment of a high temperature in heat shrinking a necessity if the goods might encounter high temperatures in transit. This, of course, increases energy costs to an even greater degree.

The applicants have now discovered a process for load unitization which utilizes a plastic net which avoids the problems experienced in the prior art. In accordance with the applicants' invention, a plastic net material comprising a plurality of sets of strands, the strands of at least one said set being substantially parallel and being in the longitudinal direction, is oriented along said one said set to a sufficient degree so that it will stretch no more than about 15%, and preferably no more than about 10%, in the direction of orientation under loads commonly encountered on pallets, even at high temperatures. In particular, the oriented plastic netting material should withstand a load, in the oriented direction, of at least 20 pounds pulling on a 3-inch strip of net at temperatures as high as 180° F. In addition to overcoming problems encountered with nets stretching after they are applied to the load resulting in the load becoming less stable, it has also been found to be of advantage if the net does not stretch significantly as it is applied. This makes the exact application tension much less critical. More specifically, it has been found that nets in which the longitudinal strands stretch no more than about 15% when subjected to a tension within 20% of the tension required to break the longitudinal strands are particularly useful in accordance with the present invention. These nets are even better when the said stretch is no more than about 10% and most preferred when the said stretch is no more than about 5%.

The plastic netting to be used in accordance with the present invention is preferably formed by an extrusion process such as those disclosed in U.S. Pat. Nos. 3,252,181; 3,384,692; 3,700,521; 3,791,784 and the like which make so-called "square mesh" nets. Alternatively, the net may be made according to a "diamond mesh" process such as disclosed in U.S. Pat. No. 2,919,467 and then helically cut as taught, for example, in U.S. Pat. No. 3,674,898 to convert it to a "square mesh net". All of these nets are well-known in the art. They are characterized by a plurality of sets of strands, the strands of at least one of the sets of strands being essentially parallel and being in the longitudinal direction. A typical net with two sets of strands at right angles and with the strands of each set being parallel is shown in U.S. Pat. No. 3,252,181, see especially FIGS. 1 and 12. As mentioned, a similar net can also be made according to U.S. Pat. No. 3,674,898, see FIG. 3. This net may have three sets of strands if desired, see British Pat. No. 1,290,437 and in particular FIGS. 1 and 2 thereof. Furthermore, the net can be a first set of parallel strands connected together by a helical strand. See, for example, U.S. Pat. No. 4,136,501. In this instance the single helical strand becomes one of the plurality of sets of strands when the tube is cut to form a flat sheet. It will be appreciated that the set of strands holding the parallel, longitudinal strands in position need not be perpendicular to the longitudinal strands nor need they even be parallel to each other. It is only necessary that they maintain the longitudinal strands in spaced relationship and substantially parallel to each other.

No matter how the particular net is formed, after formation the longitudinal strands are oriented so that they will withstand normal palletized load stresses at temperatures up to about 180° F. It is desirable that the longitudinal strands be oriented to a sufficient degree so that, after the orientation, they will stretch not more than about 15% at a tension within 20% of the tension required to break the strands and preferably not more than about 10%. All sets of strands may be oriented if desired. However, in accordance with the present invention it is only necessary that the longitudinal set of substantially parallel strands be oriented.

Methods of orienting plastic net material are well known in the art. Where only the single longitudinal set of strands is desired to be oriented, this can suitably be accomplished by so-called rope form orientation by applying racking tension, see U.S. Pat. No. 2,919,467. This rope form orientation can also be advantageously used with nets such as made by the process disclosed in U.S. Pat. No. 4,136,501.

With the so-called "square mesh" nets, such as those made according to U.S. Pat. No. 3,384,692 it is preferable that biaxial orientation be carried out so that both sets (all three sets in British Pat. No. 1,290,437) are oriented. This can suitably be accomplished with the process set forth in U.S. Pat. No. 4,152,479. The biaxial orientation is not limited to the square mesh nets and can also be used with nets such as those taught in U.S. Pat. No. 4,136,501 or those made according to U.S. Pat. No. 3,674,898.

The degree of orientation is sufficient so that, after orientation, the net will not stretch further in the longitudinal direction more than about 15% when the net is subjected to normal palletized load stresses at temperatures as high as 180° F. Furthermore, it is preferred if the longitudinal strands, after orientation, do not stretch more than about 15% when subjected to a tension within about 20% of the tension required to break the longitudinal strands. The material from which the plastic net is made may be any plastic material which can be oriented to a sufficient degree to meet one or both of the 15% maximum stretch conditions. The preferred materials for use in the present invention are thermoplastic materials, and, in particular, polyolefins, polyamides and polyesters either as homopolymers, or as copolymers or blends with each other or with other compatible materials. The most preferred material is polypropylene, but high density polyethylene is also quite excellent.

A biaxically oriented plastic netting may suitably have from about 2 to about 100 strands per 10 inches for each set of strands. It is preferred that the biaxially oriented net have from about 10 to 20 strands per 10 inches of both longitudinal strands and strands transverse to the longitudinal direction. The weight of such biaxically oriented net is suitably from about 2.0 to about 3.5 pounds per thousand square feet. If the plastic net is only uniaxially oriented, i.e. only the longitudinal set of strands is oriented, it is preferred that there be from about 10 to about 20 strands per 10 inches of longitudinal strands. The unoriented set of strands which transverse to the longitudinal strands and interconnect the longitudinal strands may suitably have from about 2 to about 100 strands per 10 inches and preferably has from 2 to about 6 strands per 10 inches. The weight of a uniaxially oriented net is suitably from about 3 to about 10 pounds per thousand square feet and preferably from about 3 to about 7 pounds per thousand square feet.

The preferred net for use in the present invention is an extruded polypropylene net formed according to U.S. Pat. No. 3,384,692 and having approximately 7 strands per inch of longitudinal strands and 5 strands per inch of strands transverse to the longitudinal strands. This net is biaxially oriented according to U.S. Pat. No. 4,152,479, after which it has approximately $1\frac{1}{2}$ strands per inch of longitudinal strands and $1\frac{1}{3}$ strands per inch of transverse strands, i.e. 3 strands per 2 inches of longitudinal strands and 4 strands per 3 inches of transverse strands. The weight of the biaxially oriented net material is approximately 3 pounds per thousand square feet.

Plastic nettings according to the present invention have been used as pallet wraps on a wide variety of palletized loads by tension wrapping the plastic netting about the load on the pallet. This is accomplished with equipment well known in the art as discussed hereinbefore. It has been found that the nets according to the present invention are markedly superior to nets available in the prior art for pallet load wrapping, especially when high temperatures and/or rough handling is encountered.

The term palletized load as used herein is used generically to mean a plurality of objects unitized with a pallet wrap. It includes, for example, a pallet or slip sheet (hereinafter collectively referred to as a pallet device) with a plurality of containers thereon, e.g. bags as shown in FIG. 1 of U.S. Pat. No. 3,945,493. As will be appreciated and as is well known in the art, the pallet wrap unitizes the load, i.e., makes it like a single unitary entity as shown in FIG. 2 of U.S. Pat. No. 3,945,493. In accordance with the present invention, the term palletized load also includes any other load which is unitized. For example, a stack of pallets can be unitized with a pallet wrap and would then be a palletized load. Similarly the term palletized load includes a stack of plywood, plaster board or the like with a pallet wrap unitizing it whether or not there is actually a pallet or slip sheet at the bottom thereof. Notwithstanding, the primary advantage of the present invention is with a palletized load comprising a pallet device and a plurality of containers thereon, especially bags such as are used with cement, food products, plastic pellets and other granular or powdered materials, and boxes, such as are used with citrus fruits, vegetables, processed foods, and the like.

The FIGURE shows a typical palletized load according to the present invention.

In the FIGURE there is shown a pallet 10 having a plurality of containers 12 thereon. Wrapped about the pallet and containers to form a palletized load is a net 14 made in accordance with the present invention. The set of strands 16 in the longitudinal direction (arrow) is stretch-oriented to a sufficient degree so that it is incapable of being stretched further by more than about 15% in said stretch-oriented direction when stressed under the tension to which normal palletized loads are subjected at temperatures up to about 180° F.

It will be understood that the claims are intended to cover all changes and modifications of the preferred embodiments of the invention herein chosen for the purpose of illustration, which do not constitute departures from the spirit and scope of the invention. It will also be understood that the pertinent portion of all patents mentioned are incorporated herein by reference,

What is claimed is:

1. In a palletized load utilizing a plastic net material as the pallet wrap, the improvement comprising said plastic net when it is wrapped about said palletized load being composed of a plurality of sets of spaced strands, the strands of at least one set being substantially parallel and being in the longitudinal direction of the net, said one set of strands being stretch-oriented to a sufficient degree so that it is incapable of being stretched further by more than about 15% in said stretch-oriented direction when stressed under the tension to which normal palletized loads are subjected at temperatures up to about 180° F.

2. The pallatized load of claim 1 wherein said one set of strands is incapable of being stretched further by more than about 10%.

3. The palletized load of claim 1 wherein said plastic netting material is polypropylene, has about 10 to 20 strands per 10 inches of longitudinal strands and about 2 to 6 strands per 10 inches in a direction transverse to the longitudinal direction and weighs about 3 to 7 pounds per thousand square feet.

4. The palletized load of claim 1 wherein the plastic net material is selected from the group consisting of polyolefins, polyamides and polyesters.

5. The palletized load of claim 1 wherein said plastic net material is polypropylene.

6. The palletized load of claim 1 wherein said plastic net material is high density polyethylene.

7. The palletized load of claim 1 wherein each set of strands of said plastic net material has from about 10 to about 20 strands per 10 inches.

8. A palletized load comprising a pallet device and a plurality of containers on said pallet device, said pallet device and said containers being unitized with a pallet wrap, said pallet wrap being a plastic net material selected from the group consisting of polypropylene and high density polyethylene, the plastic net material comprising two sets of strands, one set of which is in the longitudinal direction of the net and the strands of said one set being essentially parallel, the other said set of strands being transverse to the one said set of strands, said one set of strands being stretch-oriented to a sufficient degree so that it is incapable of being stretched further by more than about 15% in said stretch-oriented direction when stressed under the tension to which normal palletized loads are subjected at temperatures up to about 180° F., each said set of strands having from about 10 to about 20 strands per 10 inches, the weight of the plastic net material being from about 2.0 to about 3.5 pounds per thousand square feet.

9. In the process of tension wrapping palletized loads with a plastic net material, the improvement comprising said plastic net material comprising a plurality of sets of spaced strands, the strands of at least one set being substantially parallel and being in the longitudinal direction of the net, said one set of strands being stretch-oriented to a sufficient degree so that it is incapable of being stretched further by more than about 15% when subjected to a tension within 20% of the tension required to break the strands of the said one set.

10. The process of claim 9 wherein said one set of strands is incapable of being stretched further by more than about 10%.

11. The process of claim 9 wherein said one set of strands is incapable of being stretched further by more than about 5%.

12. The process of claim 9 wherein said plastic netting material is polypropylene, has about 10 to 20 strands per 10 inches of longitudinal strands and about 2 to 6 strands per 10 inches in a direction transverse to the longitudinal direction and weighs about 3 to 7 pounds per thousand square feet.

13. The process of claim 9 wherein the plastic net material is selected from the group consisting of polyolefins, polyamides and polyesters.

14. The process of claim 9 wherein said plastic net material is polypropylene.

15. The process of claim 9 wherein said plastic net material is high density polyethylene.

16. The process of claim 9 wherein each set of strands of said plastic net material has from about 10 to about 20 strands per 10 inches.

* * * * *